US005106007A

United States Patent [19]

Lyga

[11] Patent Number: 5,106,007

[45] Date of Patent: Apr. 21, 1992

[54] MAILING MACHINE ROLL TAPE TURNING BAR

[75] Inventor: Thomas M. Lyga, Torrington, Conn.

[73] Assignee: Pitney Bowes Inc., Stamford, Conn.

[21] Appl. No.: 685,784

[22] Filed: Apr. 16, 1991

[51] Int. Cl.[5] ..... B65H 27/00

[52] U.S. Cl. ..... 226/197; 242/76

[58] Field of Search ..... 226/196, 197, 179; 242/76, 15, 19

[56] References Cited

U.S. PATENT DOCUMENTS 3,462,057 8/1969 Yamamoto ..... 226/196 X
3,711,001 1/1973 Schopp ..... 226/19
4,322,043 3/1982 Grollimund ..... 226/196 X
4,953,807 9/1990 Noguchi ..... 226/196

*Primary Examiner*—Daniel P. Stodola
*Assistant Examiner*—Paul Bowen
*Attorney, Agent, or Firm*—Charles G. Parks, Jr.; David E. Pitchenik; Melvin J. Scolnick

[57] ABSTRACT

A turning bar for shifting the path of travel of a web of tape. The bar includes: a first guide having a cylindrical shaped guiding surface, wherein the axis of the cylindrically shaped guiding surface is perpendicular to the path of travel; and a second guide downstream and below the first guide, the second guide having an upper, flat surface angled to the axis and a lower, arcuate surface extending from the upper, flat surface.

3 Claims, 4 Drawing Sheets

Fig. 6.
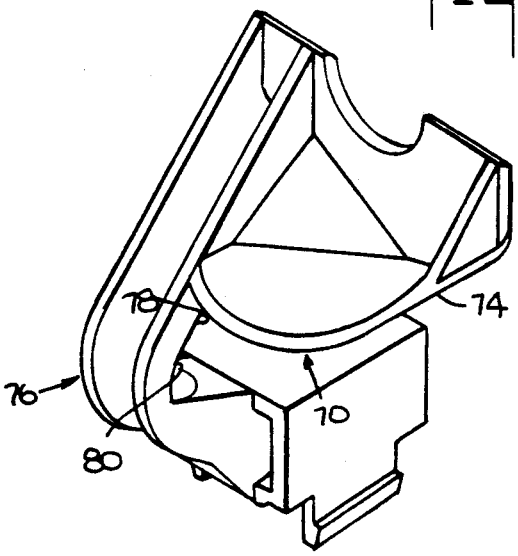
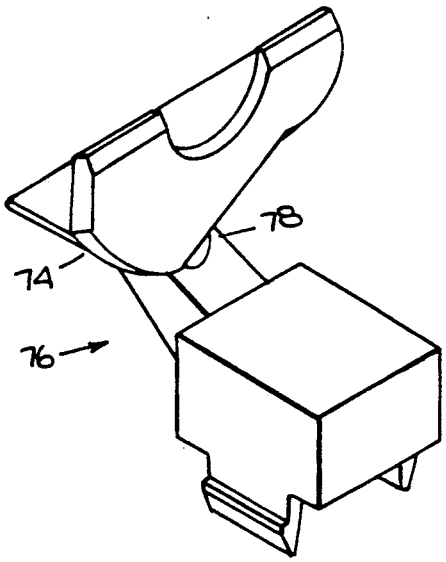
Fig. 7.
Fig. 14.
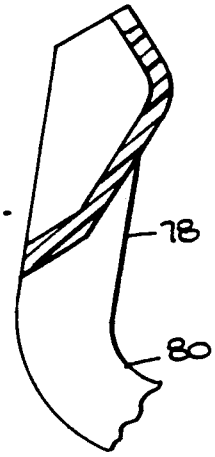
Fig. 12.
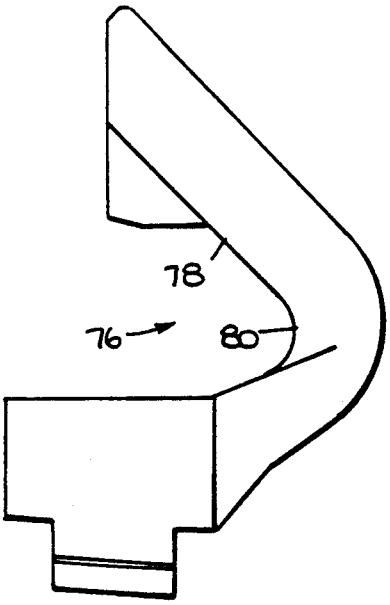
Fig. 13.
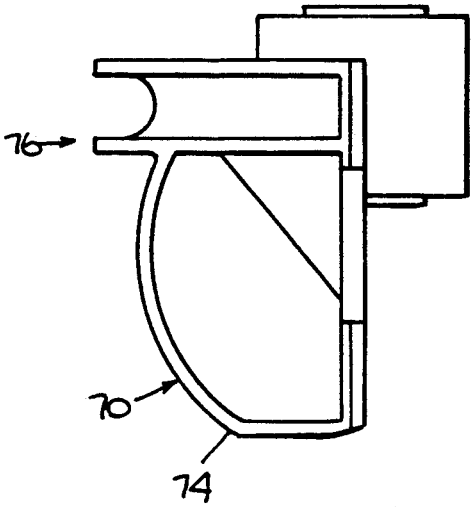

MAILING MACHINE ROLL TAPE TURNING BAR

CROSS-REFERENCE TO RELATED APPLICATIONS

The following U.S. patent applications disclose the tape apparatus disclosed herein: U.S. Pat. No. 4,922,085, titled "TAPE DRIVE"; U.S. Pat. No. 5,007,370, titled "TAPE TAKE-AWAY AND MOISTENING SYSTEM"; U.S. Pat. No. 5,016,511, titled "TAPE CUTTER"; U.S. Pat. No. 4,911,268, titled "TORQUE OR FORCE LINEARIZING DEVICE"; all filed on Dec. 28, 1988 and all assigned to the assignee of this application.

The following U.S. patent applications relate to an inking apparatus which may be used with the tape apparatus disclosed herein: U.S. Pat. No. 4,945,831, titled "INK TRAY DRIVE"; all filed on Dec. 28, 1988 and all assigned to the assignee of this application.

U.S. Pat. No. 4,935,078 titled "HIGH THROUGHPUT MAILING MACHINE TIMING", and assigned to the assignee of this application, discloses a timing and control system for a mailing machine in which the tape apparatus disclosed herein may be utilized.

A modular mailing machine, tape apparatus and inking apparatus are disclosed in the following U.S. patent applications which are assigned to the assignee of this application: U.S. Pat. No. 4,923,023, titled "MODULAR MAILING MACHINE"; U.S. Pat. No. 4,852,786, filed Dec. 17, 1987, titled "TAPE MODULE FOR A MODULAR MAILING MACHINE"; U.S. Pat. No. 4,886,132, titled "CUTTER MODULE FOR A MODULAR MAILING MACHINE"; U.S. Pat. No. 4,865,139, titled "INKING MODULE FOR A MODULAR MAILING MACHINE"; U.S. Pat. No. 4,860,025, titled "PLATEN MODULE FOR A MODULAR MAILING MACHINE".

The disclosure of all of the foregoing applications and patents are incorporated herein by reference.

BACKGROUND OF THE INVENTION

The invention disclosed herein relates generally to tape handling apparatus, particularly a reeled tape supply system and components thereof, and more particularly to a system and components thereof for supplying tape to be advanced past a printing device in a mailing machine. The invention relates further to a reeled tape supply system which supplies tape under tension, and which automatically retracts a predetermined length of tape into the tape supply system when tension withdrawing the tape is below a given value.

It is desirable for a mailing machine to process different sizes and types of mail quickly and efficiently. It is also desirable for a mailing machine to imprint postage and like indicia either directly on the mail piece or on a tape strip which is thereafter affixed to a mail piece that may be too large or too irregularly shaped to imprint postage indicia directly thereon. Moreover, for high-speed operation, it is desirable that the mailing machine selectively imprint either the mail piece or a tape without shutting down the machine to change over from imprinting mail pieces to tape and vice versa. It is also desirable for a mailing machine to imprint different types of tape, for example, a tape having a water-activated adhesive and a tape having a pressure-sensitive adhesive.

In U.S. Pat. No. 4,958,782 there is disclosed an entirely passive, reeled tape supply system which supplies at least one tape under tension, preferably constant, to a drive system withdrawing the tape. An improved passive reeled tape supply is disclosed in co-pending application Ser. No. 685,783, filed Apr. 16, 1991 and entitled "Mailing Machine Roll Tape Dispensing Apparatus". The instant invention replaces the rollers employed in the '782 patent which help direct the tape from the supply reel to a movable feeding carriage which conveys the tape to the postage meter, and is especially useful in the aforesaid co-pending application. The instant invention overcomes a problem with the '782 rollers in that the tape, in changing course, was sometimes being bent or wrinkled or twisted prior to entering the postage meter for printing. The instant invention provides a turning bar which virtually eliminates any bending of the tape prior to entering the feeding carriage.

SUMMARY OF THE INVENTION

Accordingly, the instant invention provides a turning bar for shifting the path of travel of a web of tape, including: a first guide having a cylindrically shaped guiding surface, wherein the axis of the cylindrically guiding surface is perpendicular to the path of travel; and a second guide laterally offset and below the first guide, the second guide having an upper, flat surface angled to the axis of the first guide and a lower, arcuate surface extending from the upper, flat surface.

BRIEF DESCRIPTION OF THE DRAWINGS

FIG. 6 is a perspective view of a turning bar in accordance with the instant invention;

FIG. 7 is similar to FIG. 6, but taken perpendicular thereto;

FIG. 12 is similar to FIG. 8 but taken 180 degrees opposite thereto (looking downstream);

FIG. 13 is a top, plan view of the turning bar seen in FIG. 6;

FIG. 14 is a sectional view taken on the plane indicated by the line 14—14 in FIG. 10.

DETAILED DESCRIPTION OF THE PREFERRED EMBODIMENT

Figure 1:
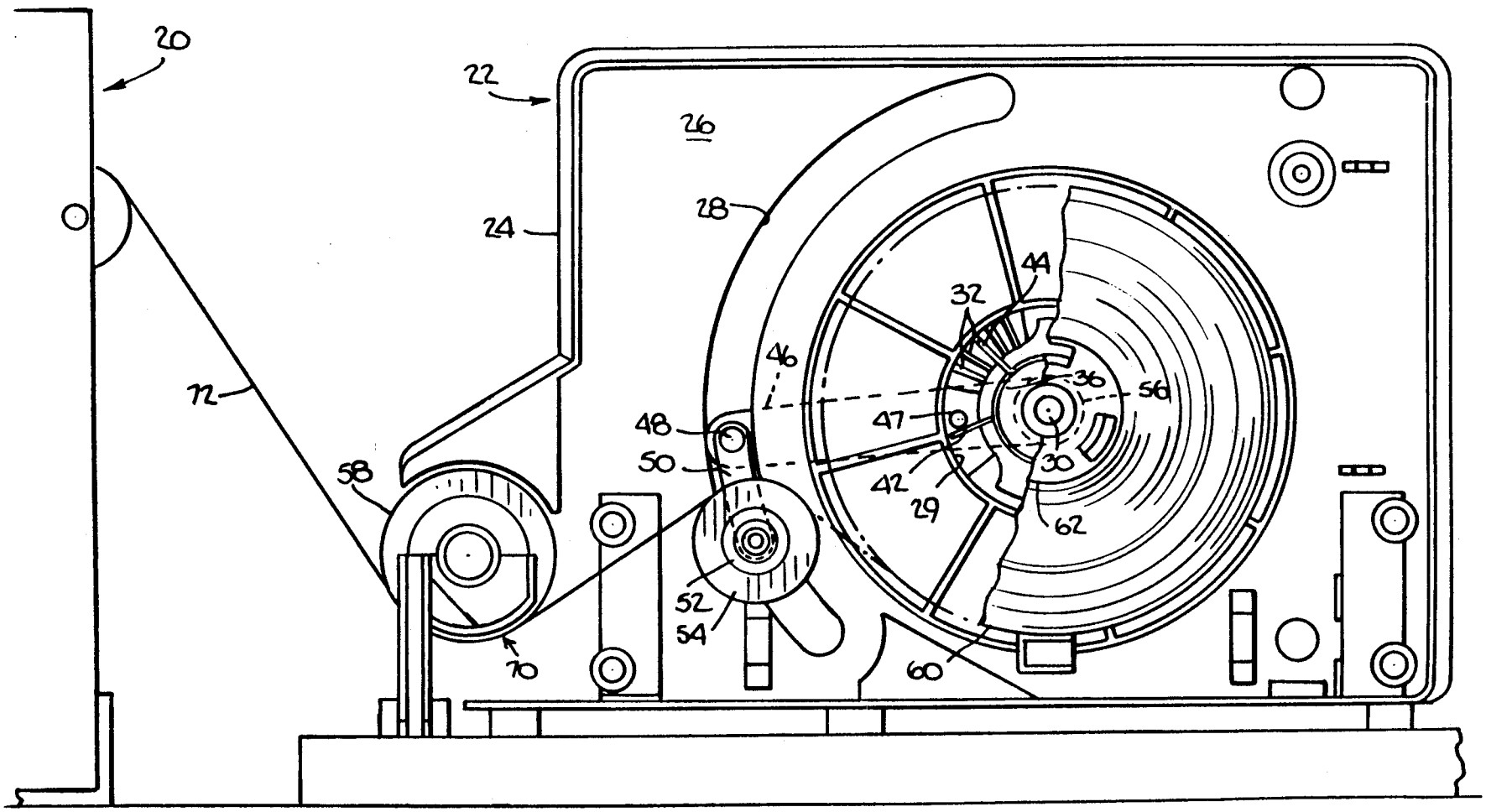
FIG. 1 is a side elevational view of a reeled tape supply system and movable, feeding carriage used in a mailing machine and which employs a turning bar in accordance with the instant invention.
Figure 2:
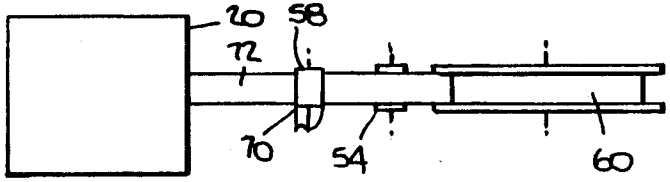
FIG. 2 is a schematic, top plan view of the tape supply system and carriage seen in FIG. 1 when tape is not being fed into a postage indicia printer.
Figure 3:
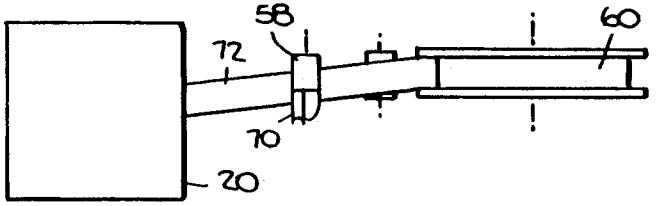
FIG. 3 is similar to FIG. 2 but shows the tape being fed into the carriage, which has been moved forward into alignment with a postage indicia printer.

In describing the preferred embodiment of the instant invention, reference is made to the drawings, wherein there is seen in FIG. 1 a movable feeding carriage 20 and a reeled tape supply system generally designated 22 upstream of the carriage 20. The tape supply system 22 includes a housing 24 which has a backwall 26 having a curved slot 28 and an opening in which is mounted a disc 29 for supporting a shaft 30 (see FIG. 2). The disc 29 further includes a series of detents 32 to be discussed further hereinbelow.

A wrap spring 36 is mounted for engagement on the shaft 30. The wrap spring 36 includes a pair of tangs 42 and 44. The tang 44 is seated in the detents 32, the exact detents depend upon the desired release and engage points for the wrap spring 36, to be discussed in greater detail hereinbelow. The other tang 42 and its seating are discussed further hereinbelow.

Also mounted on the shaft 30 is a tension arm 46 having a horizontally extending member 48 which rides in the arcuate slot 28. A link 50 connects the member 48 to a supporting shaft 52 on which is mounted a tension roller 54. A wrap spring 36 mounted on the shaft 30 provides an upward bias on the roller 54 through the tension arm 46. A guide roller 58 is rotatably mounted on the housing 24 downstream of the roller 54. The tang 44 extending from the spring 36 engages the protuberance 47 on the tension arm 46.

A roll of postage meter tape 60 is mounted on a hub 62 which is mounted to engage the shaft 30. A bail (not shown) secures the tape roll 60 on the shaft 30.

Located adjacent the guide roller 58 is a turning bar 70 for facilitating the shifting of the path of travel of the web of tape 72, as discussed further hereinbelow. The bar 70 includes an upper guide surface 74 (FIG. 4) which is cylindrically shaped. The axis of the cylindrically shaped surface 74 is perpendicular to the path of travel of the web 72. Adjacent the guide surface 74 on the turn bar 70 is a second guide 76, which is laterally offset and below the guide surface 74. The second guide 76 has an upper, flat surface 78 which is oriented at an angle to the axis of the upper guide surface 74, and a lower, arcuate surface 80 extending from the flat surface 78.

Figure 4:
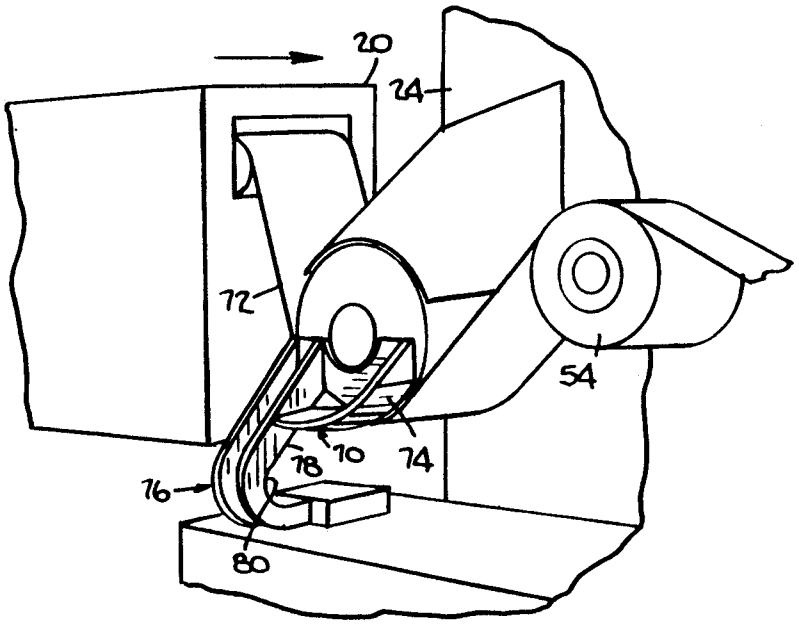
FIG. 4 is a perspective view of tape wrapping around a guide roller and entering the feeding carriage preparatory to entering a postage indicia printer.
Figure 5:
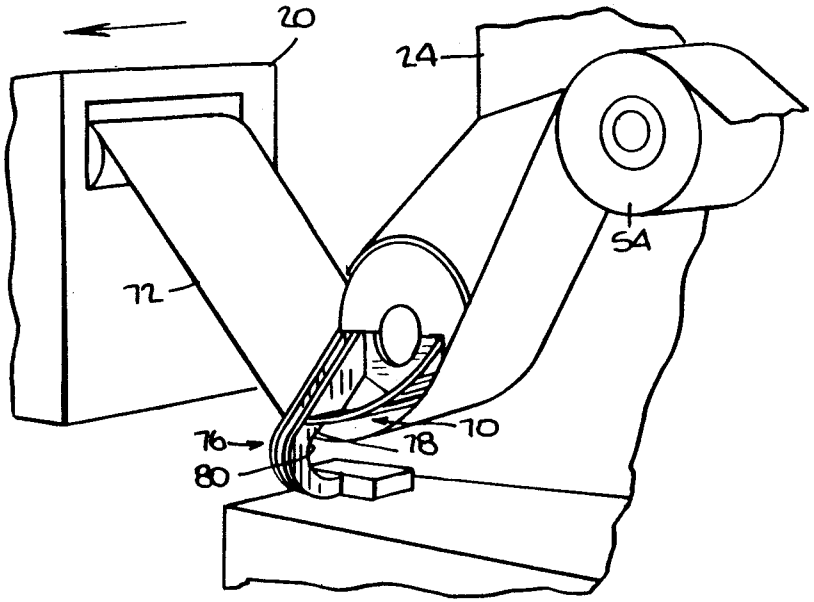
FIG. 5 is similar to FIG. 4 except that the feeding carriage has been moved for ward in order to align the tape with the postage indicia printer.
Figure 8:
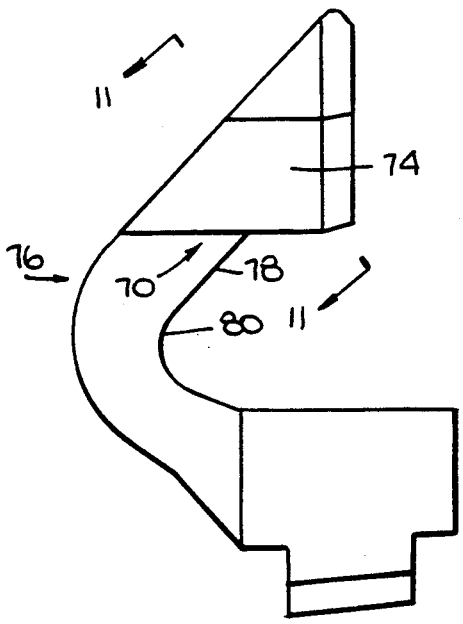
FIG. 8 is a front, elevational view (looking upstream) of the turning bar seen in FIG. 6.
Figure 9:
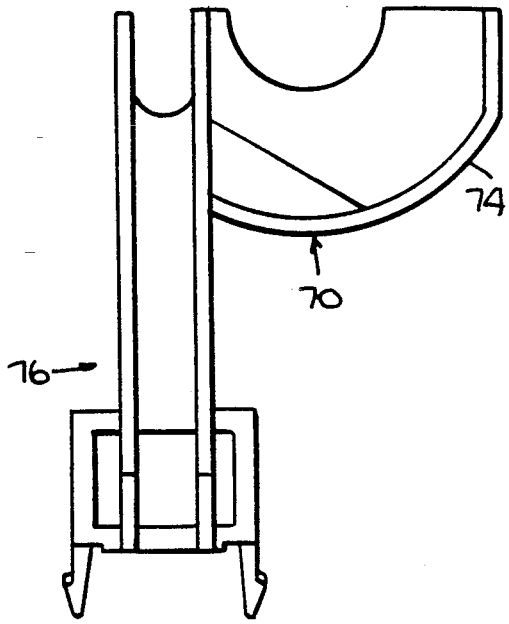
FIG. 9 is a side, elevational view of the turning bar seen in FIG. 6.
Figure 10:
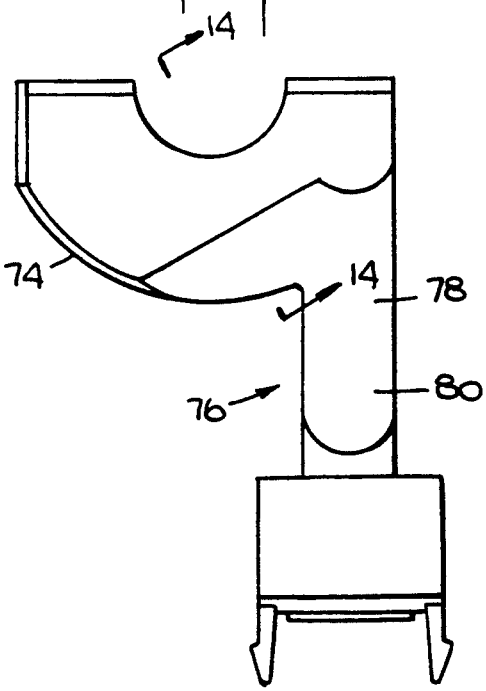
FIG. 10 is similar to FIG. 9 but taken 180 degrees opposite thereto.
Figure 11:
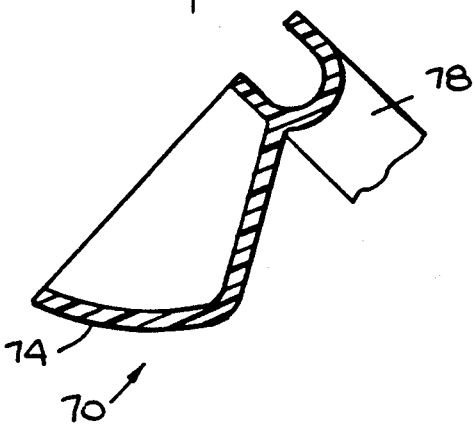
FIG. 11 is a sectional view taken on the plane indicated by the line 11—11 in FIG. 8.

The operation of the tape supply system 22 can best be understood by referring to FIGS. 1, 4 and 5. FIG. 1 illustrates the position of the supply system 22 when the roll of tape 60 is being dispensed. When the roll of tape 60 is not being dispensed and is simply being held in storage, the tension roller 54 is in a raised position to provide tension for the roll of tape 60. When the tension roller 54 is in the raised position at the top of the slot 28 owing to the bias of a spring (not shown) on the tension arm 46, the tension arm 46 is also in a raised position which tightens the wrap spring 36 which prevents the roll of tape 60 from moving and being dispensed.

When the roll of tape 60 is to be dispensed, the feeding carriage 20 will cause the roll of tape 60 to be unwound in the following manner. Movement of the roll of tape 60 from the supply system 22 to the feeding carriage 20 (for further conveying to, e.g. a postage indicia printing mechanism) creates a downward force on the roller 54 which overcomes the bias on the tension arm 46. As the tension arm 46 pivots downward, the tang 42 is rotated by the tension arm protuberance 47 so that the wrap spring 36 is loosened, thereby allowing the tape hub 62 to freely rotate, which allows the roll of tape 60 mounted on the tape hub 62 to be unwound as required by the carriage 20.

Once the supply system 20 has completed the dispensing of the roll of tape 60, the tension of the roll of tape 60 on the roller 54 is reduced, allowing the roller 54 to be pivoted upward from the position seen in FIG. 1. As the tension arm 46 is raised, the protuberance 47 pivots upward which allows the tang 42 to rotate and thereby tighten the spring 36 which locks the tape hub 62 into a fixed position. The tightening of the spring 36 then prevents any rotation of the roll of tape 60 and hence further dispensing of the roll of tape 60 is prevented.

The exact point at which the wrap spring tightens and locks the tape hub 62 is pre-determined in accordance with which of the detents 32 is selected for the tang 44 to engage.

When the roll of tape 60 is to be dispensed, the feeding carriage 20 moves forward from the position shown in FIG. 4 to the position shown in FIG. 5 in order to align the web of tape 72 with the postage indicia printing mechanism (not shown) located downstream of the carriage 20. When the carriage 20 is in the position seen in FIG. 4, the web of tape 72 engages the lower, circumferential portion of the guide roller 58. When the carriage is moved to the dispensing position seen in FIG. 5, the tape web 72 is caused to slide laterally from the roller 58 and engage the turning bar 70. The cylindrical shape of the guide surface 74 is similar to the shape of the roller 58 to facilitate the sliding motion of the web 72 as it is shuttled between dispensing and non-dispensing alignment.

It should be understood by those skilled in the art that various modifications may be made in the present invention without departing from the spirit and scope thereof, as described in the specification and defined in the appended claims.

What is claimed is:

1. A combination of a fixably located tape supply system and having a tape receiving device wherein said tape receiving device receives replenishing tape from said tape supply source, wherein the improvement comprises:

said tape receiving device being reciprocally displaceable laterally relative to said fixed location of said tape supply system and said tape receiving device being longitudinally spaced apart from said tape supply system; and a guide means for providing smooth transition of said tape while being directed from said tape supply system to said tape receiving device during lateral displacement of said tape receiving device, wherein the guide means comprises:

a guide roller;

first support means for rotatively supporting said guide roller such that when said tape receiving device is in a first position, said tape supply system and said tape receiving device are laterally aligned having said tape extend between said tape supply system and said tape receiving device such that said tape is tracked by said guide roller;

a turning bar; and second support means for fixedly supporting said turning bar such that said turning bar is aligned laterally beside said guide roller such that when said tape receiving device assumes a second position laterally displaced from said first position, said tape is directed over at least a portion of said turning bar to allow a smooth lateral transition of said tape from said tape supply system to said tape receiving device.

2. An improved combination as claimed in claim 1, wherein said turning bar comprises a frame member having a first section having a formed surface configured to aligned lateral to a lower portion of the surface periphery of said guide roller.

3. An improved combination as claimed in claim 2 wherein said frame member further comprises a second section having an arcuate second surface contiguous extending laterally from said first section to assure that a further most lateral edge of said tape is not deformed as said edge contacts with said arcuate second surface.

* * * * *